US008267052B2

(12) United States Patent
Takano

(10) Patent No.: US 8,267,052 B2
(45) Date of Patent: Sep. 18, 2012

(54) ENGINE PROVIDED WITH OIL CIRCULATION PATH AND COOLING FLUID PATH

(75) Inventor: Kiyohito Takano, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 458 days.

(21) Appl. No.: 12/318,445

(22) Filed: Dec. 30, 2008

(65) Prior Publication Data

US 2010/0162973 A1 Jul. 1, 2010

(51) Int. Cl.
*F01P 11/08* (2006.01)

(52) U.S. Cl. ..... 123/41.33; 123/196 AB; 123/196 R; 123/41.01

(58) Field of Classification Search ..... 123/41.33, 123/41.01, 196 AB
See application file for complete search history.

(56) References Cited

U.S. PATENT DOCUMENTS 2,706,469 A * 4/1955 Nallinger ..... 123/41.33
5,606,937 A * 3/1997 Calhoun ..... 123/41.28
5,690,062 A * 11/1997 Yamada ..... 123/41.33
5,967,112 A * 10/1999 Haga et al. ..... 123/196 W
5,980,340 A * 11/1999 Okamoto ..... 440/88 L
6,067,951 A * 5/2000 Kitajima ..... 123/196 R
6,263,960 B1 * 7/2001 Yamanaka et al. ..... 165/119
6,990,932 B2 * 1/2006 Kunimitsu et al. ..... 123/41.33
7,178,500 B1 * 2/2007 Belter et al. ..... 123/196 AB
7,318,405 B2 * 1/2008 Tanaka et al. ..... 123/195 C

FOREIGN PATENT DOCUMENTS

JP 3392851 3/2003
JP 3668460 7/2005

* cited by examiner

*Primary Examiner* — Noah Kamen
*Assistant Examiner* — Grant Moubry
(74) *Attorney, Agent, or Firm* — Wenderoth, Lind & Ponack, LLP

(57) ABSTRACT

An engine which can easily cool oil within an oil circulation path. The oil circulation path includes an oil reservoir, an oil pump for sucking oil from the oil reservoir so as to pressurize the oil, an oil supplying oil passage conducting the oil from the oil pump to each of lubrication points, and an oil returning oil passage for returning the oil to the oil reservoir from the lubrication points. The cooling fluid path includes a cooling fluid pump, and a cooling fluid passage for supplying the cooling fluid, which conducts the cooling fluid from the cooling fluid pump to the cooling points. The oil passage and the cooling fluid passage come into contact with each other at one or more points of the engine main body so as to be heat exchangeable via a partition wall.

4 Claims, 10 Drawing Sheets

ENGINE PROVIDED WITH OIL CIRCULATION PATH AND COOLING FLUID PATH

BACKGROUND OF THE INVENTION

1. Field of the Invention

The present invention relates to an engine provided with an oil circulation path and a cooling fluid path.

2. Description of the Prior Art

Briefly giving a description of an oil circulation path of a general engine, oil sucked by an oil pump from an oil reservoir within a crankcase or an oil tank is supplied to each of lubrication points of the engine, for example, a bearing of a crank shaft, a crank pin, a piston, a cam shaft(s) of a cylinder head, and a transmission shaft(s) and the like, via an oil passage for supplying the oil, and is used for lubricating and/or cooling in the lubrication points. Further, the oil after being supplied (used) is returned to the oil reservoir or the oil tank via an oil passage for returning. Such an oil circulation path is described, for example, in Japanese Patent No. 3668460 and the like. Further, in order to positively lower a temperature of the oil after being supplied (used), there is a structure in which an oil cooler is provided in a midstream of the oil circulation path.

Next, briefly giving a description of a cooling fluid path, in the case of a vehicle, a cooling fluid such as cooling water or the like cooled within a radiator is sucked by a water pump, is supplied to a cooling fluid jacket (or a cooling fluid gallery) of a cylinder and a cylinder head via a cooling fluid passage for supplying the cooling fluid, and is supplied (used) for cooling the cylinder and the cylinder head. The cooling fluid after being supplied (after being used) is returned to the radiator via a thermostat and the like, for example, from an upper end portion of the cylinder head, and is cooled. A cooling fluid path with such circulation type is described, for example, in Japanese Patent No. 3392851 and the like. Further, in a case of marine vessels such as personal water craft and the like, water and the like force fed from a portion near an impeller is supplied to an engine via a pipe and the like, and cools an exhaust system (near an exhaust port) of the engine. Further, a part of the water is discharged overboard for test water, and a rest of the water is mixed into an exhaust gas in the exhaust passage via a double tube portion of the exhaust system so as to be discharged overboard.

In a conventional engine provided with the oil circulation path and the cooling fluid path, the oil after being supplied (after being used) is cooled by the oil cooler and the like as mentioned above. On the other hand, the cooling fluid after being used is cooled by the radiator and the like in a circulation type, and is discharged in a disposable type. In other words, there is not provided a structure in which the cooling fluid is positively used for cooling the oil in an inner portion of the engine.

SUMMARY OF THE INVENTION

An object of the present invention is to positively enable utilization of a cooling fluid for cooling oil by devising a layout of an oil circulation path of an engine and a layout of a cooling fluid path. In order to achieve the object mentioned above, in accordance with the present invention, there is provided an engine provided with an engine main body including a crankcase, a cylinder and a cylinder head, an oil circulation path, and a cooling fluid path. The oil circulation path includes an oil reservoir or an oil tank, an oil pump sucking oil from the oil reservoir or the oil tank so as to pressurize the oil, an oil supplying oil passage conducting the oil discharged from the oil pump to each of lubrication points, and an oil returning oil passage for returning the oil to the oil reservoir or the oil tank from each of the lubrication points. The cooling fluid path includes a cooling fluid pump pressurizing the cooling fluid, and a cooling fluid passage conducting the cooling fluid discharged from the cooling fluid pump to each of cooling points. The oil passage and the cooling fluid passage come into contact with each other at one or more points of the engine main body so as to be heat exchangeable via a partition wall.

With the above configuration, since the heat exchange can be achieved between the oil and the cooling fluid, the oil can be cooled without provision of any special cooling mechanism.

In the structure mentioned above, preferably, the cylinder may be structured such that a center line thereof is inclined at a predetermined angle from a vertical direction, the oil passage coming into contact with the cooling fluid passage may be constituted by an oil passage reaching a crankcase from a lubrication point of the cylinder head via a cam chain tunnel of the cylinder, and the cooling fluid passage coming into contact with the oil passage may be constituted by a cooling fluid passage formed in the crankcase.

With the above configuration, it is possible to efficiently cool the oil in which its temperature becomes higher by being used in the cylinder head, by the cooling fluid. Further, the oil can slowly flow within the cam chain tunnel formed in the inclined cylinder, thus a heat exchange time with the cooling fluid can be extended, and an amount of heat exchange can be increased.

In the structure mentioned above, preferably, the oil passage coming into contact with the cooling fluid passage may be constituted by an oil passage reaching a crankshaft from an oil filter provided at a cylinder-inclined end portion of the crankcase. The cooling fluid passage coming into contact with the oil passage may be constituted by a cooling fluid passage formed in the crankcase.

With the above configuration, it is possible to efficiently cool the oil from the oil filter by the cooling fluid.

In the structure mentioned above, preferably, the cooling fluid passage may have one or more fin(s) or rim(s) therein.

Accordingly, it is possible to increase an area of heat exchange between the cooling fluid and the oil, for example, a contact area between the cooling fluid and the partition wall, thereby increasing the efficiency of heat exchange. As a shape of the rib, for example, a low shape extending along a length direction of the cooling fluid can be employed.

In the structure mentioned above, preferably, a protruded portion temporarily suppressing an oil flow in a portion corresponding to the contact point, in the oil passage coming into contact with the cooling fluid passage may be formed.

Accordingly, the efficiency of heat exchange between the oil and the cooling fluid can be further improved.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE INVENTION

FIGS. 1 to 9 show a first embodiment of an engine in accordance with the present invention, and a description will be given of an embodiment of the present invention with reference to these drawings.

Figure 1:
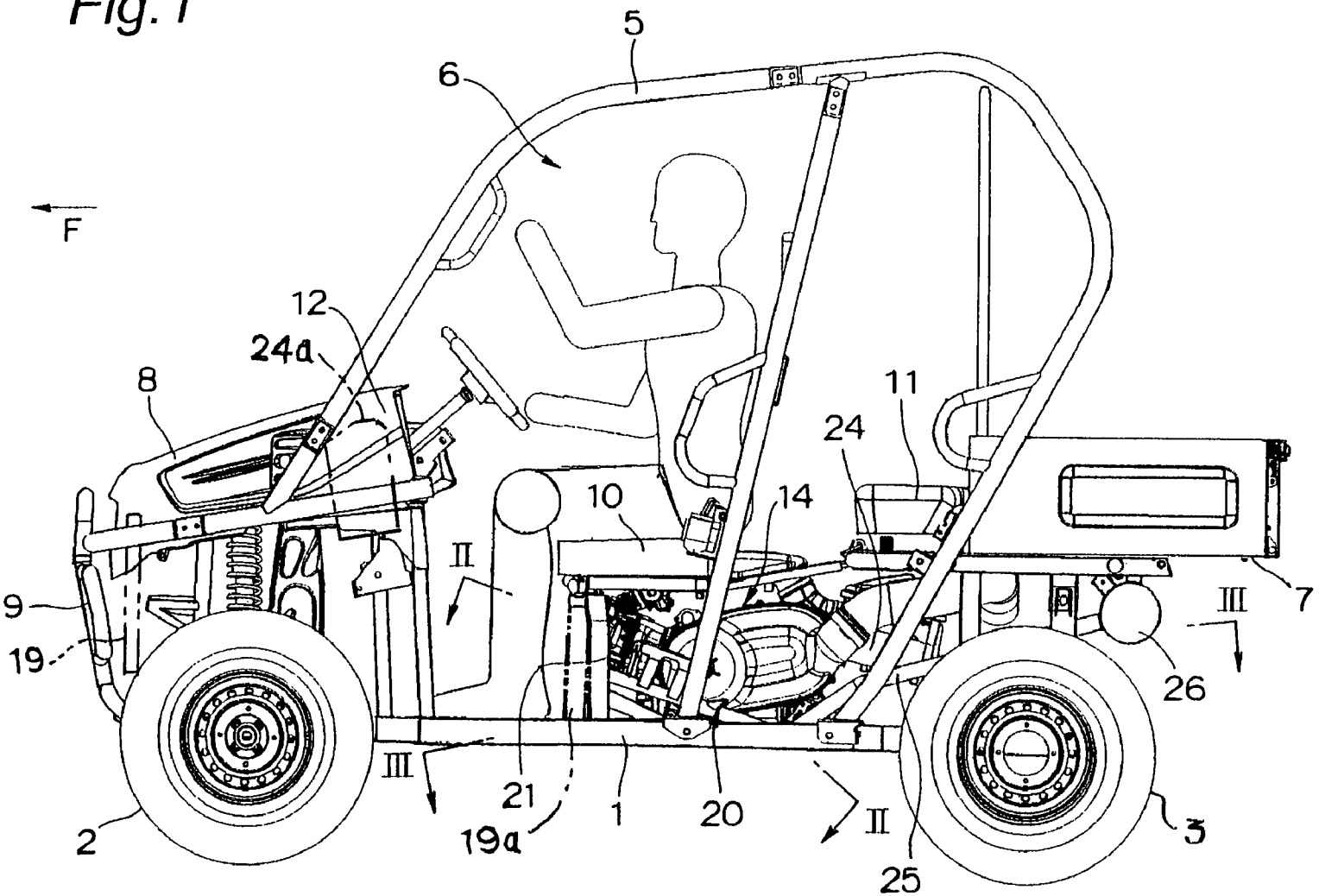
FIG. 1 is a left side view showing a four-wheel traveling vehicle mounting an engine in accordance with an embodiment of the present invention in a partly broken manner.

FIG. 1 is a left side view, partially broken away, of a small four-wheeled vehicle for irregular grounds (a so-called utility vehicle) on which an engine with a centrifugal clutch according to the present invention is mounted. In FIG. 1, the four-wheeled vehicle has a pair of right and left front wheels 2 in a front portion of a body frame 1, a pair of right and left rear wheels 3 in a rear portion of the body frame 1, a cabin 6 surrounded by a cabin frame 5 between the front wheels 2 and the rear wheels 3, a loading space 7 located rearwardly of the cabin 6, a bonnet 8 and a bumper 9 located forwardly of the cabin 6, and fenders over wheels 2 and 3.

A bench type front seat 10 is installed in a front half portion in the cabin 6. A folding, bench type rear seat 11 is installed in a rear half portion in the cabin 6. A dashboard (an operating portion) 12 is provided at a front end of the cabin 6. The front and rear seats 10 and 11 are not limited to the bench type. Alternatively, a separate type box seat may be installed.

An engine room 14 is formed from a space below the front seat 10 to a space below the rear seat 11 and is located in a substantially center portion of the vehicle in a vehicle width direction. An engine 20 is housed in the engine room 14 and is supported on the body frame 1. The engine 20 is of a single-cylinder type and has a single cylinder 21 tilted forward. In order to reduce an overall height of the engine 20, a tilt angle of the cylinder 21 is set to approximately 60° or more relative to a vertical direction. The engine 20 may have a cylinder of a V-type or of another type. The V-type engine may have cylinders arranged in V-shaped opened in fore-aft direction or in V-shaped opened in the right and left direction.

An air intake device such as an air cleaner 24 for an engine is arranged in a space rearwardly of the engine 20. An exhaust pipe 25 connected to an exhaust port (not illustrated) of the engine 20 extends rearward and is connected to an exhaust muffler 26 arranged below the loading space 7. The air cleaner 24 may be arranged in the bonnet 8 forwardly of a steering wheel.

Figure 2:
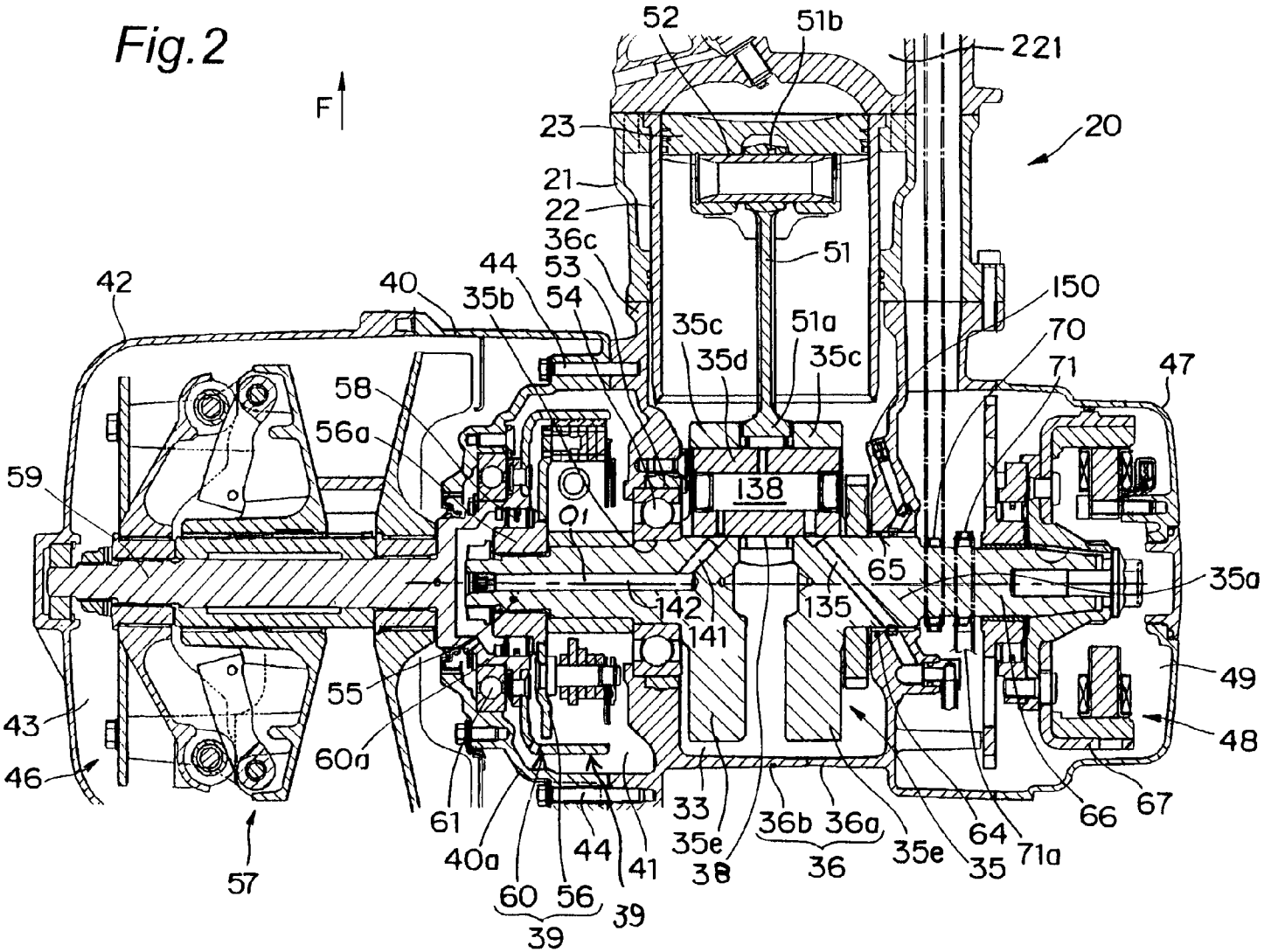
FIG. 2 is an enlarged sectional view taken along line II-II in FIG. 1.

FIG. 2 is an enlarged sectional view of the engine 20 of FIG. 1 taken along line II-II. In FIG. 2, a cylindrical cylinder liner 22 is provided in the cylinder 21. A piston 23 is slidably fitted onto an inner circumferential surface of the cylinder liner 22.

A crankshaft 35 is housed in a crank housing 33 of a crankcase 36. The crankcase 36 is divided into a right crankcase member 36*a* and a left crankcase member 36*b*. The crankcase members 36*a* and 36*b* are coupled to each other in a substantially center portion of a width of the engine 20 in a direction of the crankshaft. The cylinder 21 is coupled to a bore portion 36*c* formed at a front upper end of the crankcase 36.

Figure 3:
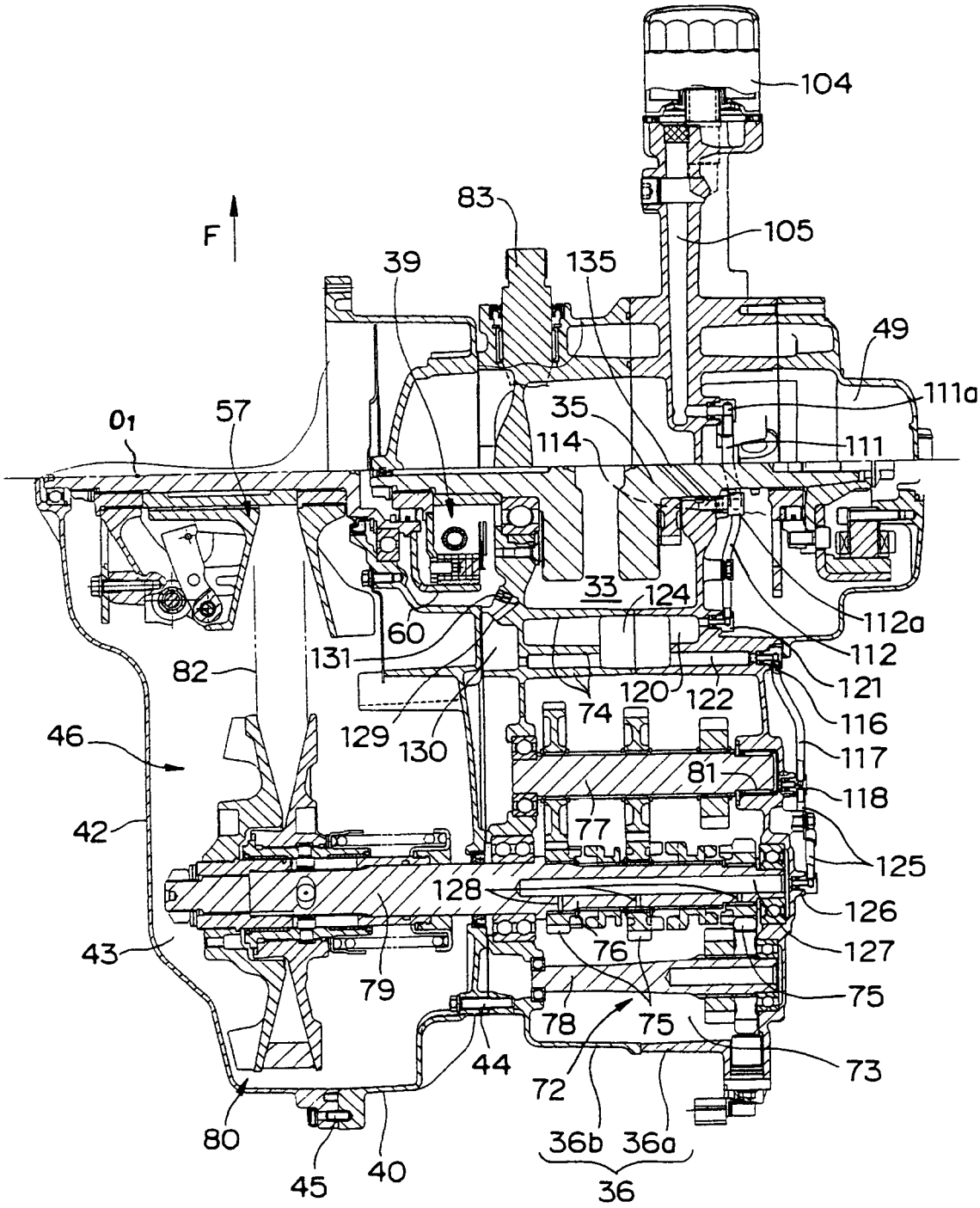
FIG. 3 is an enlarged sectional view taken along line in FIG. 1, in which an internal structure is not shown in an upper portion.

A belt converter case 40 integrally having a clutch cover 40*a* is coupled to a left end face of the left crankcase member 36*b* using a plurality of bolts 44 (FIG. 3). A clutch housing 41 which houses the centrifugal clutch 39 is formed by the clutch cover 40*a* and the left crankcase member 36*b*. A belt converter cover 42 is fastened to a left end face of the belt converter case 40 using a plurality of bolts 45. A belt converter housing 43 which houses a belt converter (V-belt type continuously variable transmission) 46 is formed by the belt converter case 40 and the belt converter cover 42.

A generator cover 47 is fastened to a right end face of the right crankcase member 36*a* using a plurality of bolts (not illustrated). A generator housing 49 which houses a generator 48 is formed by the right crankcase member 36*a* and the generator cover 47.

The crankshaft 35 has right and left journal portions 35*a* and 35*b* spaced apart from each other in the direction of the crankshaft, a pair of crank arms 35*c* and 35*c* formed between the journal portions 35*a* and 35*b*, a crankpin 35*d* which couples the crank arms 35*c* and 35*c*, and weight portions 35*e* and 35*e* which are projected in a direction radially opposite the crank arms 35*c* and 35*c*. The crankpin 35*d* is fitted onto an inner circumferential surface of a large end 51*a* of a connecting rod 51 via a plurality of rollers (or bearing metals) 38. The connecting rod 51 extends into the cylinder liner 22. A small end 51*b* of the connecting rod 51 is coupled to the piston 23 via a piston pin 52.

The left journal portion 35*b* of the crankshaft 35 is rotatably fitted in a bearing hole 53 formed in the left crankcase member 36*b* via a ball bearing 54. The left journal portion 35*b* is formed integrally with a clutch shaft 55 protruded into the clutch housing 41. A boss portion 56*a* of an inner member 56 of the centrifugal clutch 39 is spline fitted onto an outer circumferential surface of the clutch shaft 55 so as to rotate integrally with the clutch shaft 55. A boss portion 60*a* of a clutch housing 60 is fitted onto an outer circumferential surface of the boss portion 56*a* via a one-way clutch 58. The boss portion 60*a* is formed integrally with a drive shaft 59 of the belt converter 46 and is rotatably fitted onto an inner circumferential surface of the clutch cover 40*a* via a ball bearing 61.

The drive shaft 59 of the belt converter 46 is protruded into the belt converter housing 43. A drive pulley 57 of the belt converter 46 is mounted on an outer circumferential surface of the drive shaft 59.

The right journal portion 35*a* of the crankshaft 35 is rotatably fitted onto an inner circumferential surface of a bearing hole 64 formed in the right crankcase member 36*a* via a bearing metal 65. The right journal portion 35*a* is formed integrally with a generator shaft 66 protruded into the generator housing 49. A rotor 67 of the generator 48 is fixed to the generator shaft 66. The generator shaft 66 is provided with a chain sprocket (chain gear) 70 for driving a cam, and a chain sprocket (chain gear) 71 for driving an oil pump.

A cam driving chain sprocket (chain gear) 70 and a pump driving chain sprocket (chain gear) 71 are formed in the generator shaft 66, a cam chain 70*a* is wound around the cam driving chain sprocket 70, and a pump driving chain 71*a* is wound around the pump driving chain sprocket 71.

Figure 7:
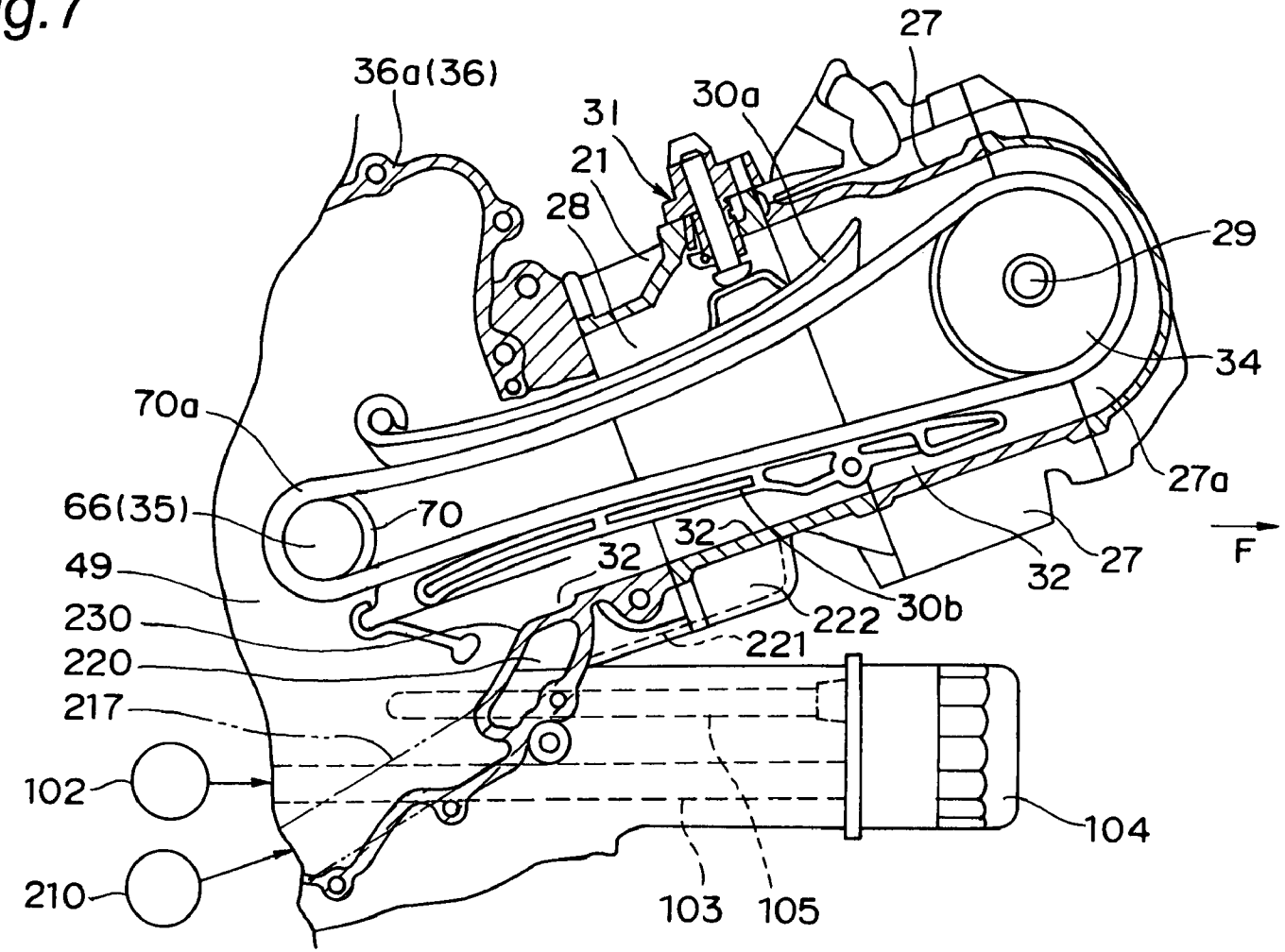
FIG. 7 is a vertical sectional view of a right end portion of a first half portion of the engine in FIG. 1.

A cam chain tunnel 28 reaching the generator chamber 49 from a rocker arm chamber 27*a* in a front face portion of a cylinder head 27 is formed in a right end portion of the bore portion 36*c* of the right crankcase member 36*a*, a right end portion of the cylinder 21, and a right end portion of the cylinder head 27. The cam chain 70*a* comes to the rocker arm chamber 27*a* from the generator chamber 49 through the cam chain tunnel 28. A front end portion of the cam chain 70*a* is wound around a sprocket 34 of an intake and exhaust valve driving cam shaft 29 provided in the front face portion of the cylinder head 27, as shown in FIG. 7.

FIG. 3 is an enlarged sectional view taken along line of FIG. 1, in which an inner structure above the crankshaft core is not shown in the drawing. In FIG. 3, a transmission case 73 which houses a gear transmission 72 is formed in a rear portion of the crankcase 36. The transmission case 73 and the front crank housing 33 are partitioned by a partition wall 74. The gear transmission 72 has a transmission input shaft 76, a countershaft 77, a reversing idle shaft 78, and an output shaft (not illustrated), which are in parallel with the crankshaft 35. Like a known gear transmission, shift gears provided respectively on the shafts 76, 77, and 78 are engaged with one another. An engaging train of the gears is selected for gear shifting. The output shaft has a gear which is engaged with an output gear of the countershaft 77. Power is transmitted from the output shaft to the front wheels 2 and the rear wheels 3 (FIG. 1) via a bevel gear mechanism (not illustrated), a two-wheel-drive or four-wheel-drive switching device (not illustrated), a forwarding drive shaft 83, and a reversing drive shaft (not illustrated).

A driven shaft 79 for the belt converter which is protruded into the belt converter housing 43 is formed integrally with a left end of the input shaft 76 of the gear transmission 72. A driven pulley 80 of the belt converter 46 is attached to the driven shaft 79. A V-belt 82 is wound around the driven pulley 80 and the drive pulley 57.

(Structure of Oil Circulation Path)

Figure 5:
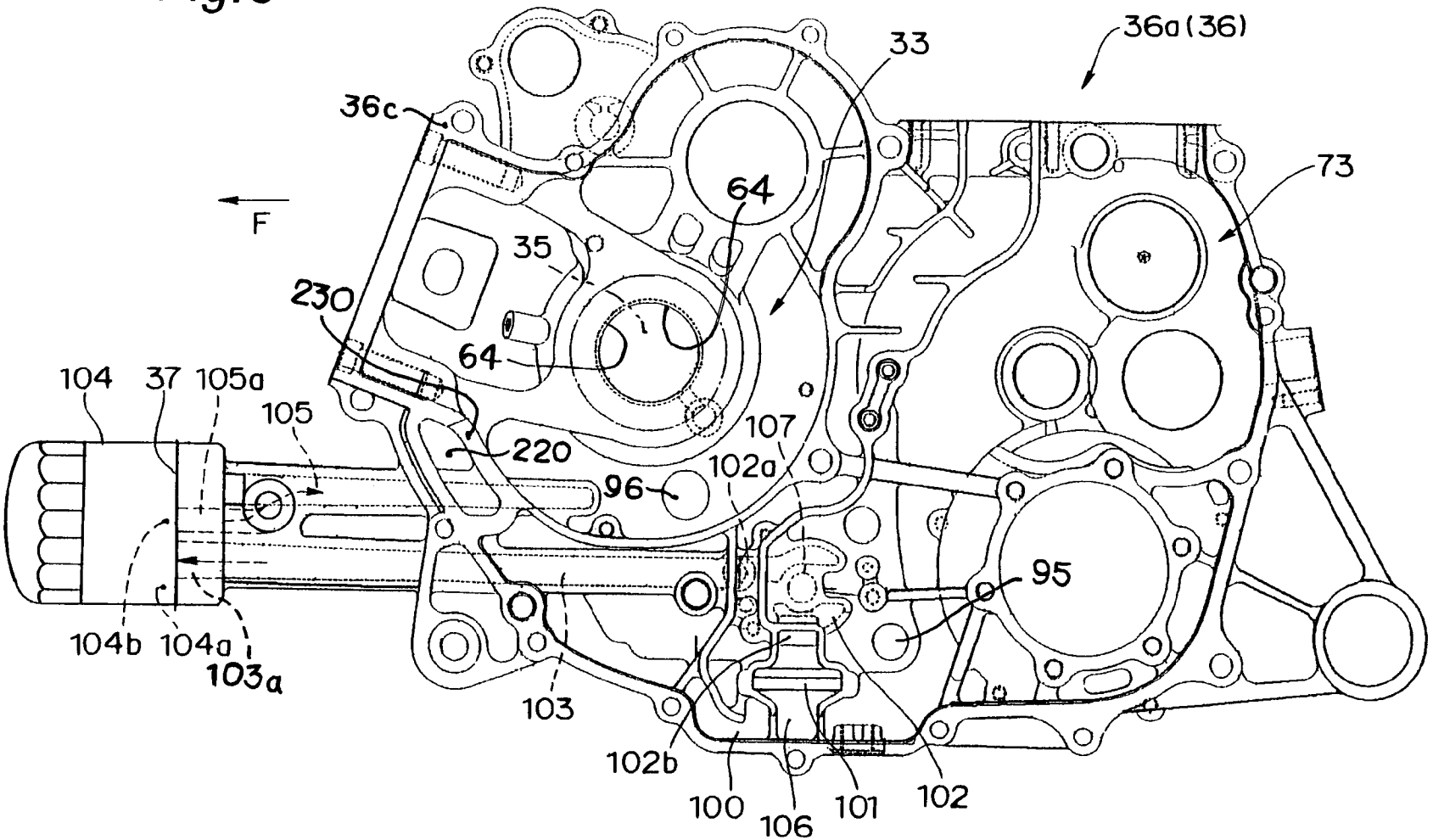
FIG. 5 is a left side view (an inner side view) of a right crankcase member of the engine in FIG. 1.

FIG. 5 is a left side view (an inner side view) of the right crankcase member 36*a*. An oil circulation path of the engine is provided with a main oil path reaching a bearing hole 64 for the crank shaft via a secondary oil filter 104 from an oil pan (an oil reservoir) 100, a plurality of sub oil paths reaching each of lubrication points within the engine from the main oil path, and a plurality of oil return paths returning to the oil pan 100 from each of the lubrication points. As the sub oil path, which will be described later in detail, there are a sub oil path for supplying the oil to a crank pin 35*d* of the crank shaft 35 shown in FIG. 2 and a centrifugal clutch 39, a sub oil path for supplying the oil to the piston 23, a sub oil path for supplying the oil to a gear type transmission 72 shown in FIG. 3, a sub oil path for supplying the oil to a cam shaft 29 shown in FIG. 7 and a rocker arm (not shown), and the other sub oil paths.

A description will be given of the main oil path. In FIG. 5, the main oil path is provided with the oil pan (the oil reservoir) 100 formed in a lower end portion of the crankcase 36, an oil suction passage 106 extending upward so as to be open to the oil pan 100, an oil pump 102 communicating with an upper end portion of the oil suction passage 106, a first main oil passage 103 communicating with a discharge portion 102*a* of the oil pump 102 and extending forward within the right crankcase member 36*a*, the second oil filter 104 attached to a front end surface 36*d* of the right crankcase 36*a*, a second main oil passage 105 extending rearward within the right crankcase member 36*a* from the secondary oil filter 104 and reaching a position in the vicinity of the bearing hole 64 for the crank shaft, and the other oil passages. An upper end portion of the oil suction passage 106 is communicated with a suction portion 102*b* of the oil pump 102.

The oil pan 100 is positioned in a front lower end portion of the transmission chamber 73. The second main oil passage 105 is arranged in an upper side of the first main oil passage 103, and extends approximately in parallel to the first main oil passage 103. A front end portion 103*a* of the first oil passage 103 is communicated with an oil inlet 104*a* of the secondary oil filter 104, and an oil outlet 104*b* of the secondary oil filter 104 is communicated with a front end portion 105*a* of the second main oil passage 105. Further, a plate-like primary oil filter 101 is arranged in a midstream of the oil suction passage 106.

Figure 8:
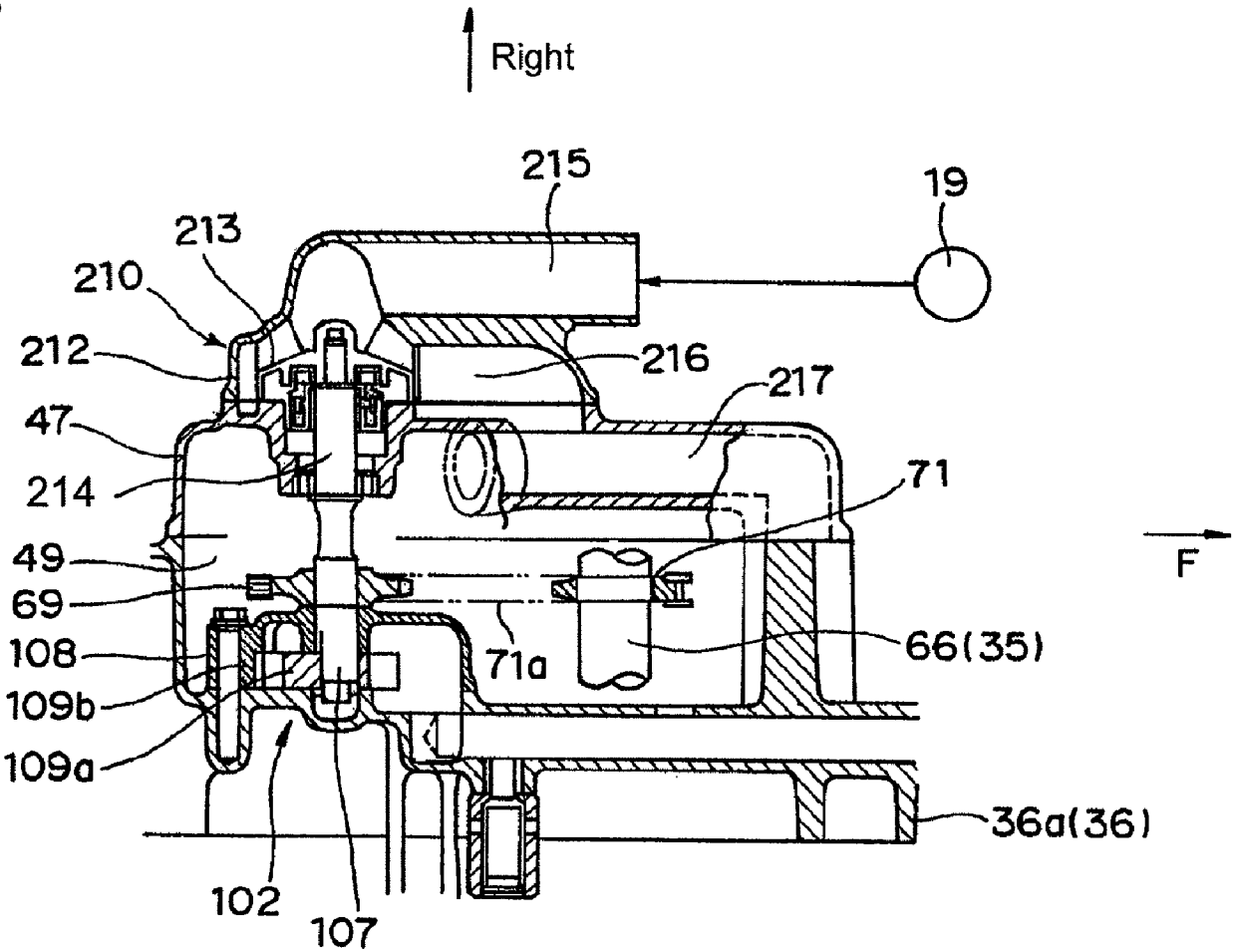
FIG. 8 is a sectional view taken along line VIII-VIII in FIG. 6 (a view seen from below)

FIG. 8 is a sectional view taken along line VIII-VIII in FIG. 6 (a view seen from below). The oil pump 102 is constituted, for example, by a trochoid pump, and is provided with a pump casing 108 attached to a right end of the right crankcase member 36*a*, inner and outer geared rotors 109*a* and 109*b* arranged within the casing 108, and an oil pump shaft 107 to which the inner rotor 109*a* is firmly attached. A sprocket 69 provided in the pump shaft 107 is coupled to the pump driving chain sprocket 71 of the generator shaft 66 via the pump driving chain 71*a* so as to be capable of transmitting power.

Figure 4:
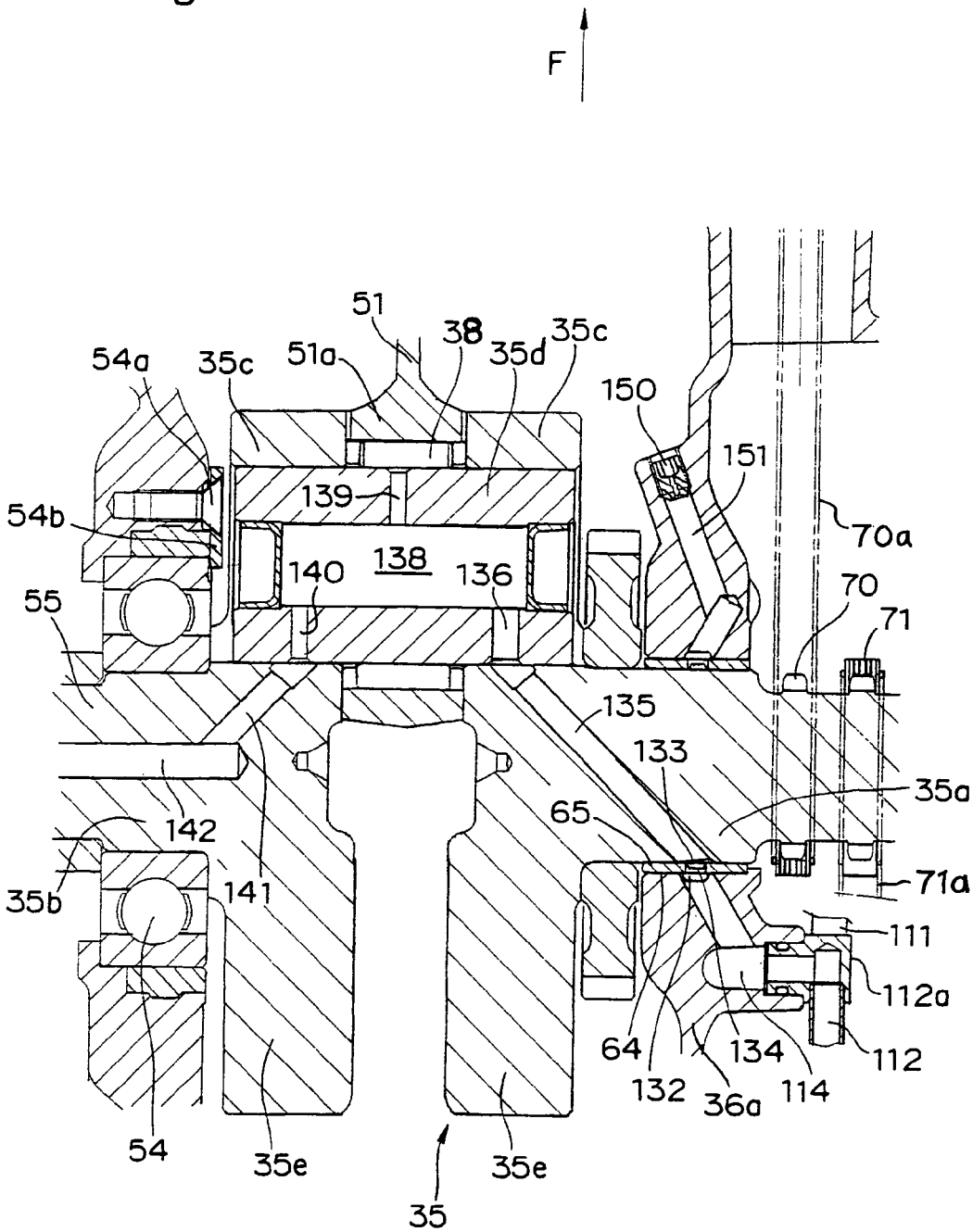
FIG. 4 is an enlarged sectional view of a crank shaft of the engine in FIG. 1.

In FIG. 3, a front end portion of a first oil tube (a main oil tube) 111 arranged in the generator chamber 49 is connected to a rear end portion of a second main oil passage 105 via a first oil joint 111*a*. The first oil tube 111 extends rearward within the generator chamber 49 so as to reach a position approximately below the crank shaft 35, and is communicated with an oil passage 114 formed within a wall of the right crankcase member 36*a*, as shown in FIG. 4, via a second oil joint 112*a*. The oil passage 114 is communicated with a right oil passage (an upstream side oil passage) 135 within the crank shaft 35.

A description will be given of one of the sub oil paths for cooling the centrifugal clutch. The second oil coupling 112*a* is further connected to a second oil pipe 112 extending rearward. A rear end of the second oil pipe 112 is connected to an oil passage 120 for the second oil supplying means formed in the partition wall 74 between the crank housing 33 and the transmission case 73 via an oil coupling 121.

In the partition wall 74, a rear oil passage 122 for the second oil supplying means is formed rearwardly of and above the oil passage 120. The rear oil passage 122 is communicated with the front oil passage 120 via a communication housing 124 in the partition wall 74 and extends in right and left directions in substantially parallel with the crankshaft 35.

A left end of the rear oil passage 122 is communicated with a second oil nozzle 131 of the second oil supplying means for cooling the centrifugal clutch via an oil chamber 130 formed in the left crankcase member 36*b*. A right end of the rear oil passage 122 is communicated with the oil supplying means for supplying oil to the gear transmission 72.

A description will be given of oil supplying means for the gear transmission. In FIG. 3, a right end of the rear oil passage 122 in the partition wall 74 is connected to a third external oil pipe 117 via a fourth oil coupling 116. The third oil pipe 117 extends rearward and is communicated with a fifth oil coupling 118 attached to a right side wall of the transmission case 73 (a right side wall of the right crankcase member 36*a*). The fifth oil coupling 118 is communicated with a needle bearing 81 of the countershaft 77 of the gear transmission 72. The fifth oil coupling 118 is connected to a fourth oil pipe 125 extending rearward, and the like. A rear end of the fourth oil pipe 125 is communicated with a sixth oil coupling 126 attached to the right side wall of the transmission case 73 (the right side wall of the right crankcase member 36*a*). The sixth oil coupling 126 is communicated with an oil passage 127 formed in the input shaft 76 of the gear transmission 72. The oil passage 127 extends leftward in the input shaft 76. A plurality of radially extending branch passages 128 are communicated with the oil passage 127. The branch passages 128 are also communicated with a fitting portion of a transmission gear 75 on the input shaft 76.

A description will be given of the sub oil path in the crankshaft 35, another sub oil path for the centrifugal clutch and the sub oil path for the piston. In FIG. 4, the oil passage 114 in the right crankcase member 36*a* which is communicated with the second coupling 112*a* extends upward to be communicated with an annular oil passage 132 formed in an inner circumferential surface of a bearing hole 64 of the right crankcase member 36*a*. The annular oil passage 132 is communicated with the right oil passage 135 in the crankshaft 35 through a radial oil hole 134 formed in the bearing metal 65 and an annular groove 133 formed in an inner circumferential surface of the bearing metal 65. The annular oil passage 132 of the bearing hole 64 is communicated with an oil nozzle 150 for cooling the piston via another oil passage 151 (not illustrated).

The right oil passage 135 in the crankshaft 35 extends toward the crankpin 35*d* and is communicated with a fitting portion (a portion where the roller 38 is arranged) between the large end 51*a* of the connecting rod 51 and the crankpin 35*d* through a right oil hole 136 formed rightwardly of the crankpin 35*d* and an intermediate oil hole 139 formed in an oil chamber 138 in the crankpin 35*d* and in the center portion in an axial direction of the crankpin 35*d*.

The oil chamber 138 within the crank pin 35*d* is further communicated with the left oil passage 141 within the crank shaft 35 via a left oil hole 140 formed in a left side of the crank pin 35*d*, and the left oil passage 141 is further communicated with an oil passage 142 for a centrifugal clutch formed in an axial core portion of the crankshaft 35. In FIG. 2, a first oil nozzle 145 provided in a left end portion of the oil passage 142 for the centrifugal clutch is structured such as to inject the oil toward an end surface of the boss portion 60*a* of the clutch housing 60 of the centrifugal clutch 39 (the right end surface of the drive shaft 59).

Figure 9:
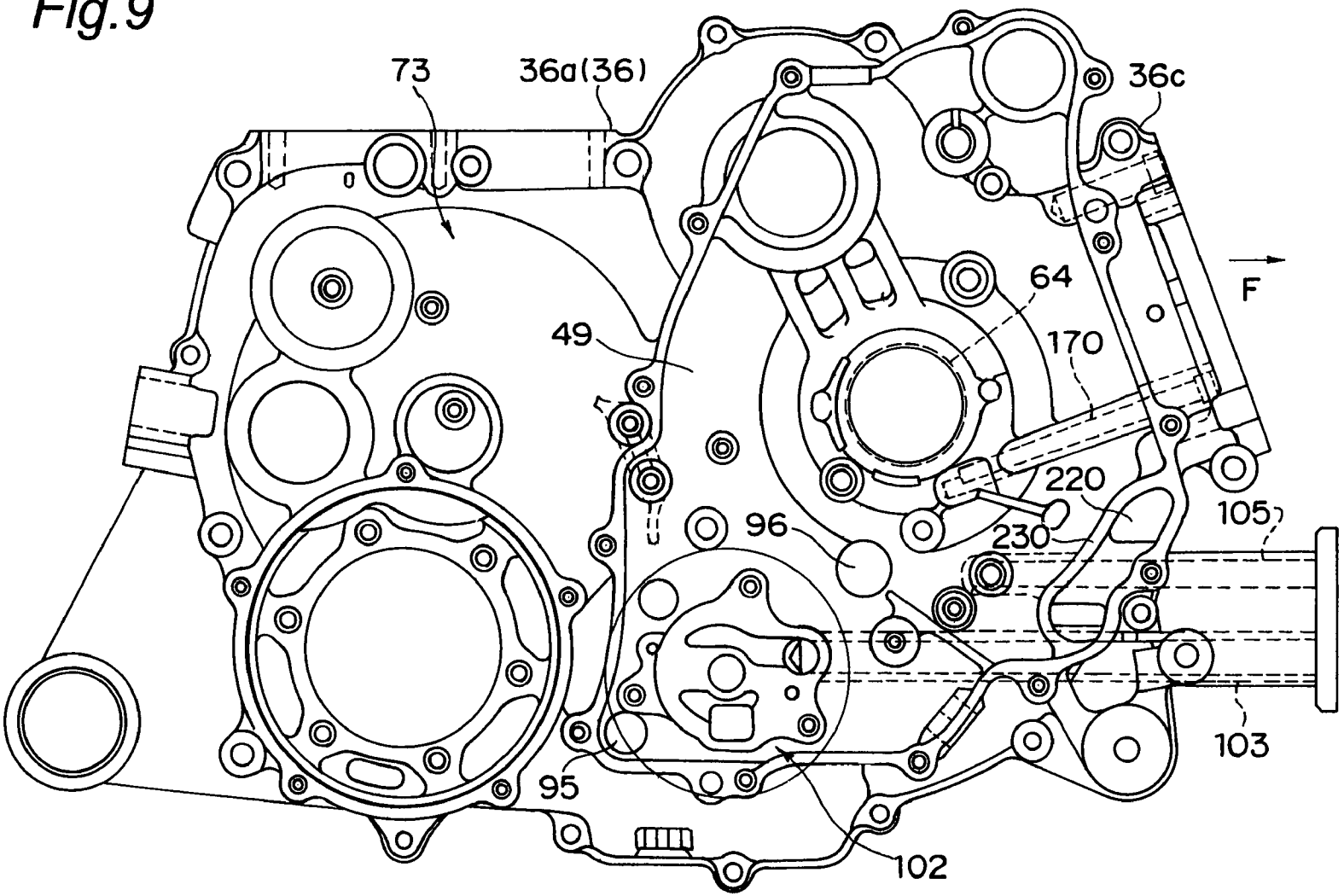
FIG. 9 is a right side view of a right crankcase member of the engine in FIG. 1.

A description will be given of the sub oil path for the cam shaft. In FIG. 4, a piston cooling oil passage 151 reaching a piston cooling oil nozzle 150 is communicated with an annular oil passage 132 of the bearing hole 64, and a cam shaft lubricating oil passage 170 formed within the right crankcase member 36*a* is communicated therewith as shown in FIG. 9. The cam shaft lubricating oil passage 170 extends to a front end of the bore portion 36*c* of the right crankcase member 36*a*, and is communicated with a lubrication portion of the cam shaft 29 shown in FIG. 7 via an oil tube and an oil passage which are not shown, and supplies oil to the cam shaft 29.

A description will be given of an oil return passage from the cylinder head 27. In FIG. 7, within the cam chain tunnel 28, there are arranged an upper chain guide 30*a* guiding an upper end edge of the cam chain 70*a*, and a lower chain guide 30*b* guiding a lower end edge of the cam chain 70*a*, together with the cam chain 70*a*, and the upper chain guide 30*a* is provided with a cam chain tensioner 31. The lower chain guide 30*b* is arranged in an above side which is spaced at a predetermined distance from a bottom surface of the cam chain tunnel 28, whereby a returning oil passage 32 is provided in a lower end portion of the cam chain tunnel 28. In other words, the oil return passage 32 extends rearward along the bottom surface of the cam chain tunnel 28 from the rocker arm chamber 27*a* in a front face portion of the cylinder head 27, and reaches the generator chamber 49.

The generator chamber 49 is structured, as shown in FIG. 9, such that a rear lower end portion is communicated with a transmission chamber 73 (FIG. 5) via a communication hole 95, and is communicated with a crank chamber 33 (FIG. 5) via the other communication hole 96, and a part of the oil in the crank chamber 33 is discharged to the transmission chamber 73 via the generator chamber 49.

(Structure of Cooling Fluid Circulation Path)

Figure 6:
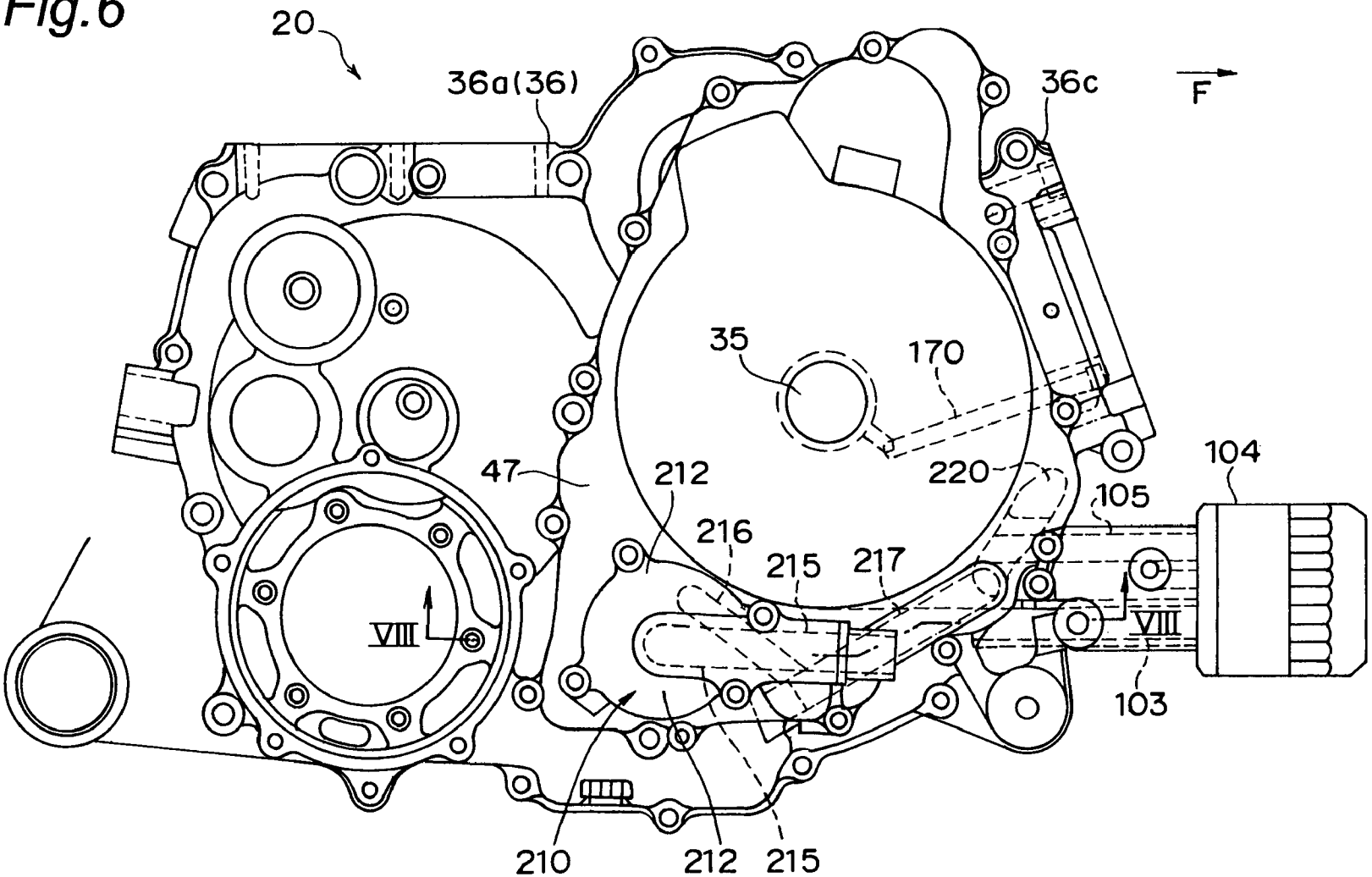
FIG. 6 is a right side view (an outer side view) showing a crankcase of the engine in FIG. 1 in a state in which a generator cover and a pump casing are attached.

The cooling fluid circulation path is configured by the radiator 19 shown in FIG. 1, a cooling fluid pump 210 shown in FIG. 6, a cooling fluid jacket 211 shown in FIG. 2, a thermostat (not shown), and a plurality of cooling fluid passages and the like. In FIG. 2, the cooling fluid jacket 211 is formed within the cylinder 21 and the cylinder head 27. The cooling fluid jacket 211 within the cylinder 21 surrounds an outer periphery of the cylinder liner 22, and the cooling fluid jacket 211 within the cylinder head 27 covers a ceiling wall surface of the combustion chamber and a periphery of the exhaust port. A cooling fluid outlet (not shown) is formed in a front upper end portion of the cooling fluid jacket of the cylinder 27, and a thermostat (not shown) is arranged therein.

In FIG. 8, in the present embodiment, for example, cooling water is used as the cooling fluid, and a water pump is used as the cooling fluid pump 210. The cooling fluid pump 210 has a pump casing 212 attached to a right end surface of the generator cover 47, and an impeller 213 arranged within the pump casing 212. A pump shaft 214 to which the impeller 213 is firmly attached is integrally formed coaxially with the pump shaft 107 of the oil pump 102, and is structured such that power is transmitted via the sprocket 69 and, the drive chain 71*a*. In this case, as the other example of the power transmission, the other transmission structures such as a gear drive and the like may be employed.

The pump casing 212 has an intake passage 215 and a discharge passage 216. The intake passage 215 extends forward, and is communicated with the cooling fluid outlet of the radiator 19 via a hose and the like. On the other hand, the discharge passage 216 is communicated with a cooling fluid passage 217 within the generator cover 47.

In FIG. 6, the cooling fluid passage 217 of the generator cover 47 extends to a forward upper side within the wall of the generator cover 47, and a front end portion thereof is communicated with a cooling fluid passage 220 in a front end portion of the right crankcase member 36*a*.

In FIG. 7, the cooling fluid passage 220 in the front end portion of the right crankcase member 36*a* is positioned approximately at the same height as the second main oil passage 105, extends in a left direction approximately in parallel to the crank shaft 35, and reaches the left crankcase member 36*b*. The left crankcase member 36*b* has a cooling water passage 221 communicating with a left end portion of the cooling water passage 220, and the cooling water passage 221 extends forward in a lower end portion of the bore portion 36*c*, and is communicated with a cooling water passage 222 in a lower end portion of the cylinder 21. The cooling water passage 222 in the lower end portion of the cylinder 21 is communicated with a cooling fluid jacket 211 within the cylinder 21 shown in FIG. 2.

In FIG. 7, in peripheral walls surrounding the cooling water passage 220 of the right crankcase member 36*a*, an outer peripheral surface of a wall portion 230 reaching a rearward lower end portion via a rear portion from an upper end portion of the cooling fluid passage 220 is smoothly connected to a rear end of the returning oil passage 32 of the cam chain tunnel 28, and extends to a rearward lower side within the generator chamber 49. Accordingly, heat exchange can be achieved via a wall portion 230, between the oil flowing through a surface of the wall portion 230 from the oil passage 32, and the cooling fluid flowing within the cooling fluid passage 220.

Further, the peripheral wall of the second main oil passage 105 passes through the cooling fluid passage 220 in a front and rear direction, whereby the heat exchange can be achieved via the peripheral wall of the main oil passage 105, between the oil within the second main oil passage 105 and the cooling water within the cooling fluid passage 220.

(Operation)

First of all, a description will be given briefly of the flow of the cooling water in the circulation type cooling water path. In FIG. 6, the cooling fluid discharged from the cooling fluid pump 210 passes the cooling fluid passage 217 of the pump casing and the cooling fluid passage 217 of the generator cover 47, and is supplied to the cooling fluid passage 220 in a rearward lower end of the bore portion 36*c* of the crankcase 36. In FIG. 7, the cooling fluid supplied to the cooling fluid passage 220 of the right crankcase member 36*a* flows through the cooling fluid passage 220 of the left crankcase member 36*b* in the left side, passes through the cooling fluid passage 221 of the left crankcase member 36*b* and the cooling fluid passage 22 of the cylinder 21, is supplied to the cooling fluid jacket 211 of the cylinder 21 in FIG. 2, and cools the cylinder liner 22 and the like. Further, the cooling fluid is supplied to the cooling fluid passage 221 of the cylinder head 27 from the cooling fluid passage 211 of the cylinder 21, cools the periphery of the ceiling wall and the exhaust port of the combustion chamber, and is thereafter returned to the radiator 19 in FIG. 1 via the thermostat (not shown) from the cooling water outlet portion (not shown) formed in the forward upper end portion of the cylinder head 27.

Next, a description will be given briefly of the flow of the oil in the oil circulation path. In FIG. 5, the oil within the oil pan 100 is sucked via the primary oil filter 101 by the oil pump 102, is discharged into the first main oil passage 103 from the discharge portion 102*a*, and is force fed to the front end surface 36*d* of the crankcase 36 within the first main oil passage 103.

The oil supplied to the secondary oil filter 104 through the oil inlet 104*a* from the front end portion of the first main oil passage 103 is filtrated, and is thereafter supplied to the second main oil passage 105 through the oil outlet 104*b*, and is force fed to a position below the crank shaft 35 within the second main oil passage 105. Since the second main oil passage 105 passes through the inner side of the cooling fluid passage 220 within the right crankcase member 36*a*, the heat exchange is achieved via the peripheral wall (the partition wall) of the second main oil passage 105, between the cooling fluid within the cooling fluid passage 220 and the oil within the second main oil passage 105. In other words, the oil within the second main oil passage 105 is cooled by the cooling fluid.

As mentioned above, the oil is supplied from the rear end portion of the second main oil passage 105 to each of the sub oil path for supplying the oil to the crank pin 35*d* of the crank shaft 35, the centrifugal clutch 39 and the like shown in FIG. 2, the sub oil path for supplying the oil to the piston 23, the sub oil path for supplying the oil to the gear type transmission 72 shown in FIG. 3, the sub oil path for supplying the oil to the cam shaft 29 of the cylinder head 27 shown in FIG. 7 and the rocker arm (not shown), and the other sub oil path.

The oil supplied to the crank pin 35*d*, the piston 23 and the like in FIG. 2 is returned to the transmission chamber 73 from the crank chamber 33, for example, via the communication hole 96, the generator chamber 49 and the communication hole 95 in FIG. 9. The oil supplied to the gear type transmission 72 in FIG. 3 is returned directly to the transmission chamber 73. Further, the oil supplied to the cam shaft 29 and the like in FIG. 7 is discharged to the returning oil passage 32 within the cam chain tunnel 28, flows rearward within the returning oil passage 32, and further flows on an outer peripheral surface of the wall portion 230 of the cooling fluid passage 220 so as to be discharged to the generator chamber 49. The heat exchange is achieved between the oil from the returning oil passage 32 and the cooling fluid within the cooling fluid passage 220, when the oil flows on the outer peripheral surface of the wall portion 230. In other words, the oil is cooled by the cooling fluid. In this case, the oil discharged to the generator chamber 49 is returned to the transmission chamber 73 through the communication hole 95 (FIG. 9).

In accordance with the present embodiment, since the cooling fluid passage 220 in FIG. 7 and the returning oil passage 32 of the cam chain tunnel 28 are arranged in such a manner as to come into contact with each other via the wall portion 230 of the peripheral wall of the cooling fluid passage 220, and the second main oil passage 105 passes through the cooling fluid passage 220, the heat exchange is achieved via the wall portion 230 and the like between the cooling fluid within the cooling fluid passage 220 and the oil within the returning oil passage 32 and the second main oil passage 105. In other words, the oil is cooled by the cooling fluid.

Other Embodiment

Figure 10:
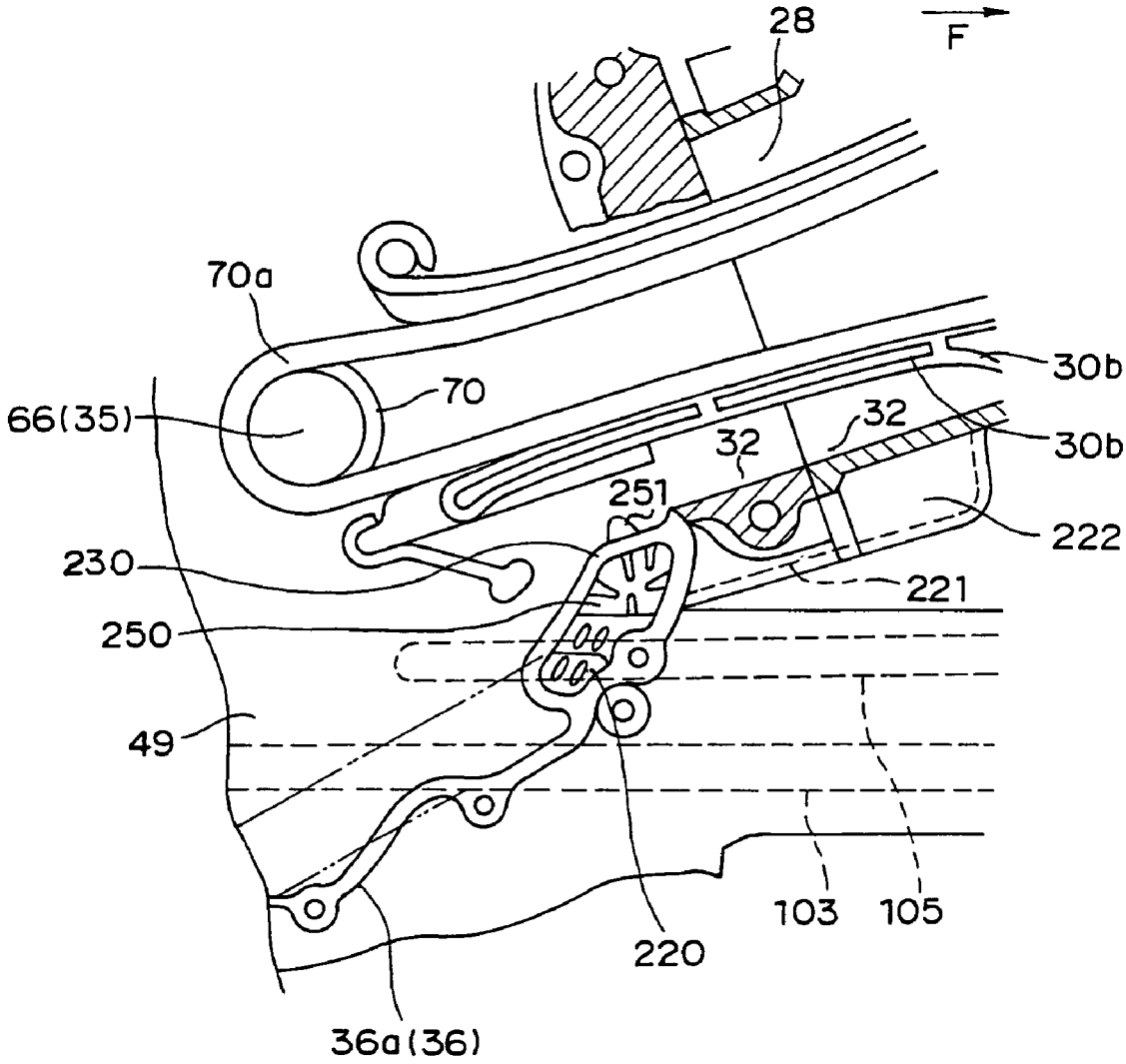
FIG. 10 shows another embodiment in accordance with the present invention, and is a similar sectional view to FIG. 7.

FIG. 10 shows a modified embodiment in accordance with the present invention, in which a multiple cooling fins 250 are formed in an inner peripheral surface of the cooling fluid passage 220 provided in a front end portion of the crankcase 36. The cooling fins 250 are formed, for example, in such a manner as to extend along the flow of the cooling fluid. Accordingly, heat exchange efficiency is improved between the oil and the cooling fluid. In other words, the efficiency of the heat exchange is enhanced by making a surface area of the contact portion wide. Further, a protruded portion 251 suppressing a flow rate of the oil from the returning oil passage 32 is formed in an upper end surface of the wall portion 230 of the cooling fluid passage 220, the oil is temporarily stopped by the portion 251, the flow rate of the oil is made slow, and the heat exchange efficiency between the oil and the cooling fluid is improved. Further, the flow rate of the oil may be made slow by forming a recess portion in place of the protruded portion 251. In both cases, a heat exchange time between the oil and the cooling fluid is made longer.

In the embodiment mentioned above, the contact points between the oil path and the cooling fluid path come into contact via the partition wall integrally formed in the crankcase, however, the structure may be made such as to isolate the cooling fluid path and the oil path by other isolating members such as a plate member and the like.

As the structure in which the oil path and the cooling fluid path come into contact via the partition wall, it is possible to put a tubular cooling water piping through the oil path. In this case, a tube wall of the cooling water piping corresponds to the partition wall. Note that a tube member which is independent from the crankcase, or a tubular portion which is integrally formed therewith can be used for the cooling water piping. Further, a tube member having a circular or rectangular cross sectional shape may be used as the piping.

In the above embodiment, the heat exchange efficiency is improved by forming the fins within the cooling fluid passage, however, it is also possible to increase a surface area coming into contact with the cooling water and enhance a cooling effect of the oil, by forming a rib which is long and low in a flow direction of the cooling water, such as the fin 250 mentioned above.

The cooling fluid used in the cooling fluid circulation path is not limited to the cooling water, but a cooling fluid including various medicines or additive agents can also be used.

The present invention is not limited to the engine mounted to the irregular ground four-wheel traveling vehicle as shown in FIG. 1, but can also be applied to engines other than the engine for the vehicle, in addition to an engine for the vehicle mounted to various vehicles such as a motorcycle, a tricycle and the like, a personal water craft and the like. Further, the present invention can be also applied to an engine having a plurality of cylinders.

The present invention is not limited to the structure in accordance with the above embodiment, but includes various modified examples considerable in the scope without departing from the contents described in the claims.

What is claimed is:

1. An engine for a vehicle provided with an engine main body including a crankcase for housing a crankshaft extending in a right and left direction, a forwardly-inclined cylinder and a cylinder head, an oil circulation path, and a cooling fluid path, wherein:

the oil circulation path includes an oil reservoir or an oil tank formed on a bottom side of the crankcase, an oil pump sucking oil from the oil reservoir or the oil tank so as to pressurize the oil, an oil supplying oil passage conducting the oil discharged from the oil pump to each of a plurality of lubrication points, and an oil returning oil passage for returning the oil to the oil reservoir or the oil tank from each of the lubrication points;

the cooling fluid path includes a cooling fluid pump pressurizing the cooling fluid, and a cooling fluid passage extended in the right and left direction in the crankcase, and conducting the cooling fluid discharged from the cooling fluid pump to each of a plurality of cooling points;

the oil returning oil passage reaches the crankcase from the lubrication points of the cylinder head via a cam chain tunnel of the cylinder;

the oil returning oil passage comes into contact with the cooling fluid passage at least at one point of the engine main body so as to be heat exchangeable between the cooling fluid and the returned oil from the cylinder head via a wall portion of a peripheral wall of the cooling fluid passage;

the oil supplying oil passage reaches the crankshaft from an oil filter provided at a cylinder-inclined end portion of the crankcase; and the oil supplying oil passage also comes into contact with the cooling fluid passage so as to be heat exchangeable via a wall portion of a peripheral wall of the oil supplying oil passage.

2. The engine for the vehicle as claimed in claim 1, wherein the cooling fluid passage has one or more fins or rims therein.

3. The engine for the vehicle as claimed in claim 1, further comprising:

a protruded portion for suppressing an oil flow in a portion corresponding to the contact point, the protruded portion being located in the oil returning oil passage coming into contact with the cooling fluid passage.

4. The engine for the vehicle as claimed in claim 3, wherein the protruded portion is formed in an upper surface of the wall portion of the cooling fluid passage.

* * * * *